US007624842B2

(12) United States Patent
Mizutani

(10) Patent No.: US 7,624,842 B2
(45) Date of Patent: Dec. 1, 2009

(54) EXHAUST SYSTEM FOR AN ENGINE AND MOTORCYCLE INCLUDING THE EXHAUST SYSTEM

(75) Inventor: Masami Mizutani, Shizuoka (JP)

(73) Assignee: Yamaha Hatsudoki Kabushiki Kaisha, Sizuoka-Ken (JP)

( * ) Notice: Subject to any disclaimer, the term of this patent is extended or adjusted under 35 U.S.C. 154(b) by 6 days.

(21) Appl. No.: 11/868,359

(22) Filed: Oct. 5, 2007

(65) Prior Publication Data

US 2008/0251314 A1 Oct. 16, 2008

(30) Foreign Application Priority Data

Oct. 6, 2006 (JP) ..... 2006-275488

(51) Int. Cl.
*F01N 1/02* (2006.01)

(52) U.S. Cl. ..... 181/249; 181/212; 181/250; 181/257; 181/227

(58) Field of Classification Search ..... 181/249, 181/250, 251, 257
See application file for complete search history.

(56) References Cited

U.S. PATENT DOCUMENTS

| | | | | | |
|---|---|---|---|---|---|
| 4,234,054 | A * | 11/1980 | Chapin | 181/252 |
| 5,033,581 | A * | 7/1991 | Feuling | 181/257 |
| 5,625,173 | A * | 4/1997 | Woods | 181/227 |
| 7,374,016 | B2 * | 5/2008 | Yamaguchi et al. | 181/249 |
| 2005/0067217 | A1 * | 3/2005 | Hansen | 181/227 |
| 2008/0110155 | A1 * | 5/2008 | Harada | 60/276 |

FOREIGN PATENT DOCUMENTS

| | | | |
|---|---|---|---|
| EP | 421724 | A1 * | 4/1991 |
| JP | 06-264741 | | 9/1994 |
| JP | 06264741 | * | 9/1994 |

* cited by examiner

*Primary Examiner*—Jeffrey Donels
*Assistant Examiner*—Forrest M Phillips
(74) *Attorney, Agent, or Firm*—Hogan & Hartson LLP

(57) ABSTRACT

An exhaust system for an engine that reduces muffler weight, assures a silencing effect and prevents a leak of exhaust gas. A muffler has an inner cylinder disposed in an outer cylinder, and is separated into a plurality of expansion chambers. A communicative passage for communicatively connecting the expansion chambers together is formed between the outer and inner cylinders. Edge parts of the communicative passage contact the outer cylinder and are welded thereto.

10 Claims, 8 Drawing Sheets

EXHAUST SYSTEM FOR AN ENGINE AND MOTORCYCLE INCLUDING THE EXHAUST SYSTEM

RELATED APPLICATIONS

This application claims the benefit of priority under 35 USC 119 of Japanese patent application nos. 2006-275488, filed on Oct. 6, 2006, which application is hereby incorporated by reference in its entirety.

BACKGROUND OF THE INVENTION

1. Field of the Invention

The present invention relates to an exhaust system for an engine of a motorcycle including an exhaust pipe and a muffler.

2. Description of Related Art

An exhaust system for a motorcycle must reduce exhaust sound as much as possible. In this regard, separating the inside of the muffler into a plurality of expansion chambers which are communicatively connected by pipe dampens exhaust energy and reduces exhaust sound.

However, there is a problem in that disposing a plurality of communicative pipes in the muffler increases the weight of the muffler and deteriorates traveling performance.

In consideration of this problem, JP-A-Hei 6-264741 suggests a muffler for a motorcycle in which a space is formed by disposing an inner cylinder with a small diameter in an outer cylinder, forming a small pipe part is formed that concaves inside the inner cylinder, and filling the space with a sound absorbing member such as glass wool.

This construction reduces the weight of the muffler. However, because the space is communicatively connected to the small pipe part, glass wool filled in the space scatters outside by passing through the small pipe part, and exhaust gas enters the space from the small pipe part. Exhaust sound tends to leak outside from there, and thus a silencing effect may not be obtained satisfactorily.

SUMMARY OF THE INVENTION

The present invention is made in consideration of the foregoing circumstance and provides an exhaust system that reduces the weight of the muffler and assures a silencing effect to prevent leak of exhaust sound.

The present invention provides an exhaust system for an engine having an engine, an exhaust pipe connected to the engine, and a muffler connected to the exhaust pipe. The muffler has an inner cylinder disposed in an outer cylinder, and is separated into a plurality of expansion chambers. A communicative passage for communicatively connecting the expansion chambers is formed between the outer and inner cylinders, and both edge parts of a part constructing the communicative passage of the inner cylinder contact the outer cylinder and are welded thereto.

The inner cylinder may be disposed in the outer cylinder such that there is disposed a space between them, or such that the inner cylinder abuts against or firmly contacts an inner peripheral surface of the outer cylinder.

In the exhaust system according to the present invention, a communicative passage for communicatively connecting the expansion chambers is formed between the outer and inner cylinders. Both edge parts of the part of the inner cylinder constructing the communicative passage contact the outer cylinder and are welded thereto. Consequently, exhaust gas flowing in the communicative passage does not enter the space between the inner and outer cylinders. Therefore, exhaust sound does not leak outside from the space between the cylinders, and a silencing effect is thus assured.

The communicative passage formed between the outer and inner cylinders communicatively connects the expansion chambers. Thus, a communicative pipe as conventionally used is not necessary, and the weight and cost of the muffler is reduced.

Other features and advantages of the invention will be apparent from the following detailed description, taken in conjunction with the accompanying drawings which illustrate, by way of example, various features of embodiments of the invention.

DETAILED DESCRIPTION OF THE INVENTION

An embodiment of the present invention is now described with reference to the attached drawings.

FIGS. 1-6 depict an exhaust system for an engine according to a first embodiment of the present invention. The terms "front", "rear", "right", and "left" in the following description are directions from the perspective of a driver sitting on a seat.

Figure 1:
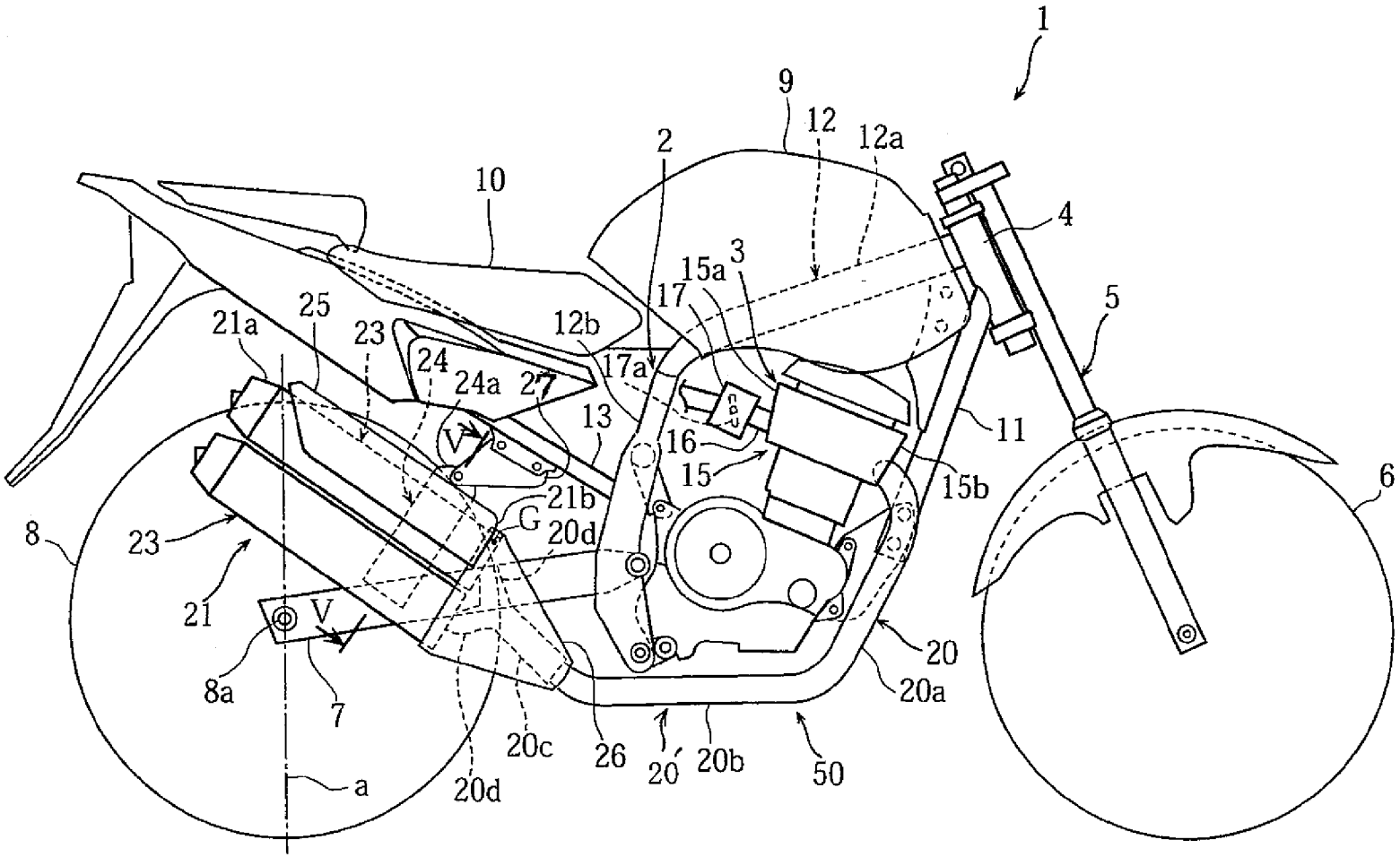
FIG. 1 is a side view of a motorcycle having an exhaust system for an engine according to a first embodiment of the present invention.
Figure 2:
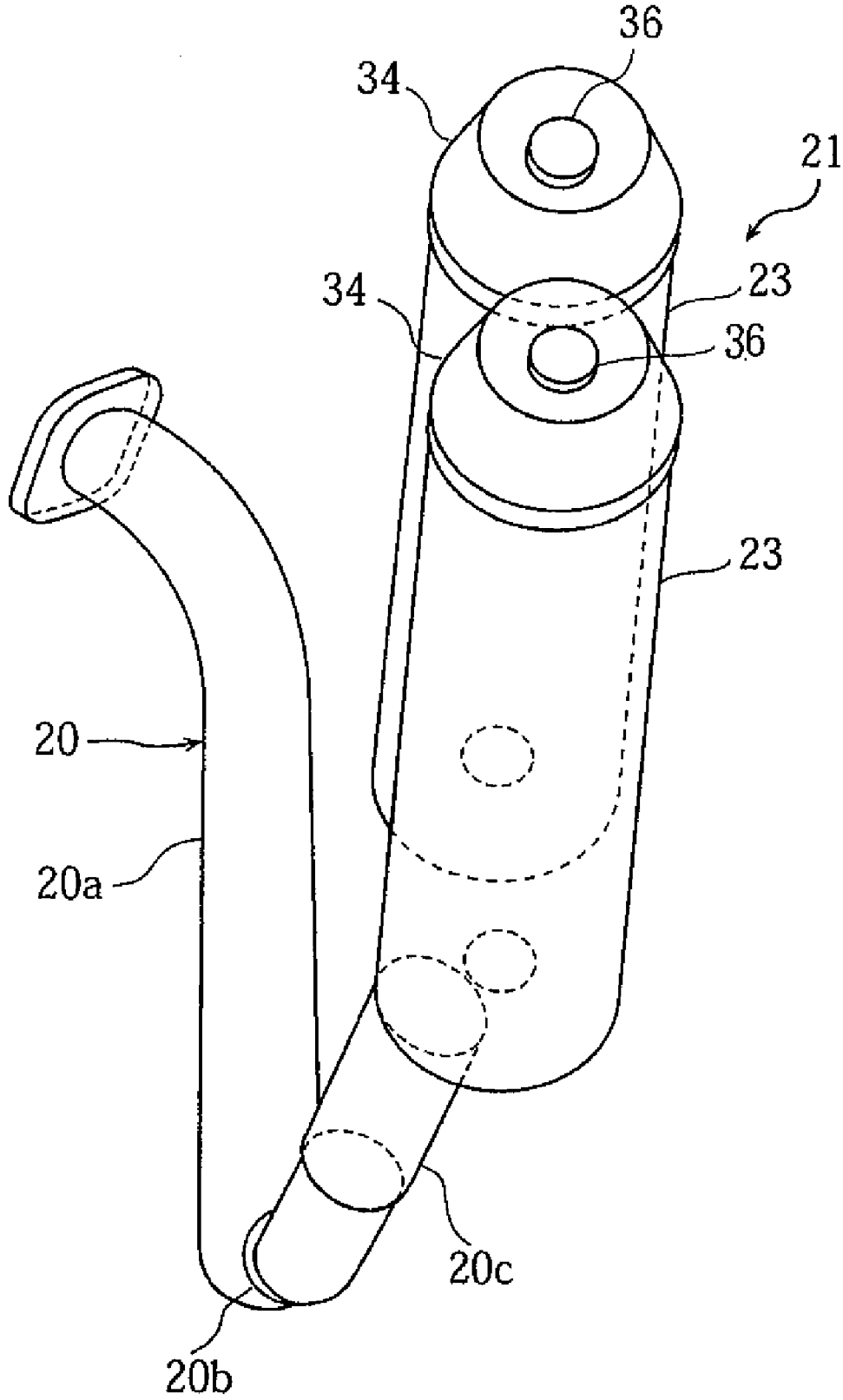
FIG. 2 is a rear view of the exhaust system.
Figure 3:
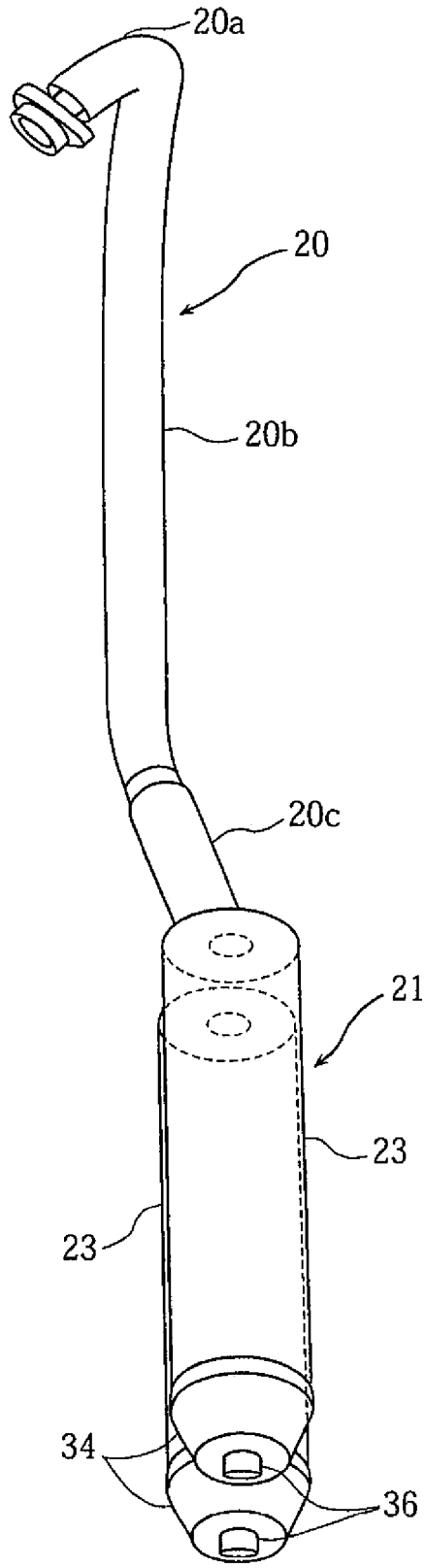
FIG. 3 is a plan view of the exhaust system.

In FIG. 1, motorcycle 1 includes an exhaust system according to the invention. Motorcycle 1 includes a diamond-shaped vehicle body frame 2, an engine 3 mounted on body frame 2, and an exhaust system 50 connected to engine 3.

A front fork 5 is supported steerably in the transverse direction by a head pipe 4 disposed at a front end of body frame 2. A front wheel 6 is disposed at a bottom end of front fork 5. Steering handlebars (not shown) are disposed at a top end of front fork 5.

A rear arm 7 is supported swingably in a vertical direction at a lower part of a rear end of body frame 2. A rear wheel 8 is disposed at a rear end of rear arm 7.

A fuel tank 9 is disposed above engine 3 of body frame 2. A straddle type seat 10 is disposed on a rear side of fuel tank 9.

Body frame 2 has a down tube 11 extending obliquely downward from a lower part of head pipe 4, an upper tube 12 having a tank rail part 12*a* extending rearward from an upper part of head pipe 4 and a rear arm supporting part 12*b* extending rearward and curving downward from a rear end of tank rail part 12*a*, and a seat rail 13 extending obliquely upward and rearward from rear arm supporting part 12*b*.

In one embodiment, engine 3 is an air-cooled four cycle single cylinder engine mounted with its cylinder axis inclining forward, laid over down tube 11 and upper tube 12 and connected there, and constructs a part of vehicle body frame 2.

An intake system is connected to engine 3. The intake system has an intake pipe 16 connected to a rear wall 15*a* of a cylinder head 15 of engine 3, a throttle body 17 containing a throttle valve 17*a* connected to intake pipe 16 inside, and an air cleaner connected to throttle body 17.

Exhaust system 50 has an exhaust pipe 20 connected to a front wall 15*b* of cylinder head 15 of engine 3, and a muffler 21 connected to a downstream end of exhaust pipe 20.

Exhaust pipe 20 is disposed on a right side of vehicle body frame 2 and has an exhaust pipe main body 20', and bifurcating branches 20*d*, 20*d* connected to a rear end of exhaust pipe main body 20'. Viewed from a lateral side of the vehicle, exhaust pipe main body 20' has an upstream exhaust part 20*a* extending downward from front wall 15*b* of cylinder head 15, a downstream exhaust part 20*b* extending rearward from a rear end of upstream exhaust part 20*a* and passing below engine 3, and a rear inclining part 20*c* extending obliquely upward and rearward from a rear end of downstream exhaust part 20*b*. Rear inclining part 20*c* (downstream end) bifurcates up and down into bifurcating branches 20*d*, 20*d*.

Figure 4:
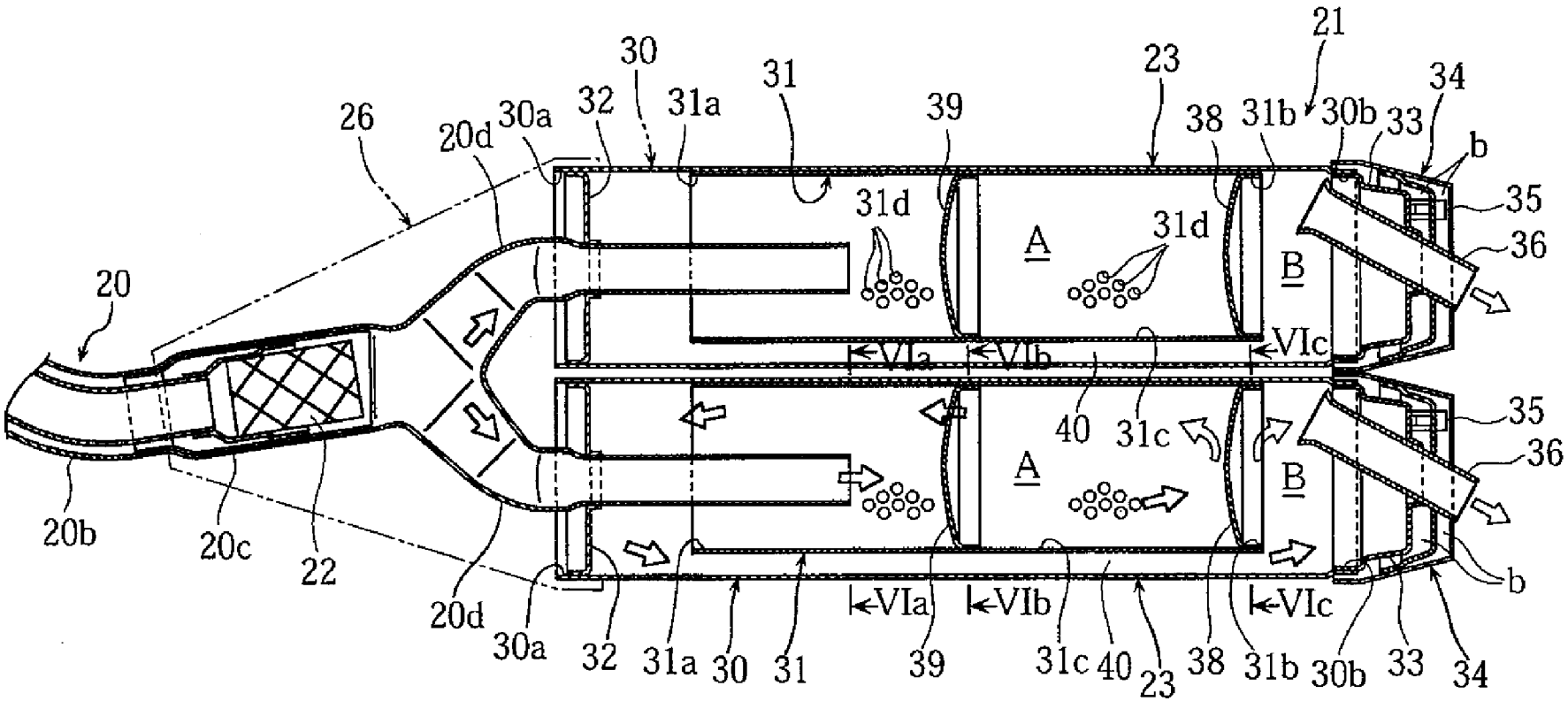
FIG. 4 is a cross sectional view of a muffler of the exhaust system.
Figure 5:
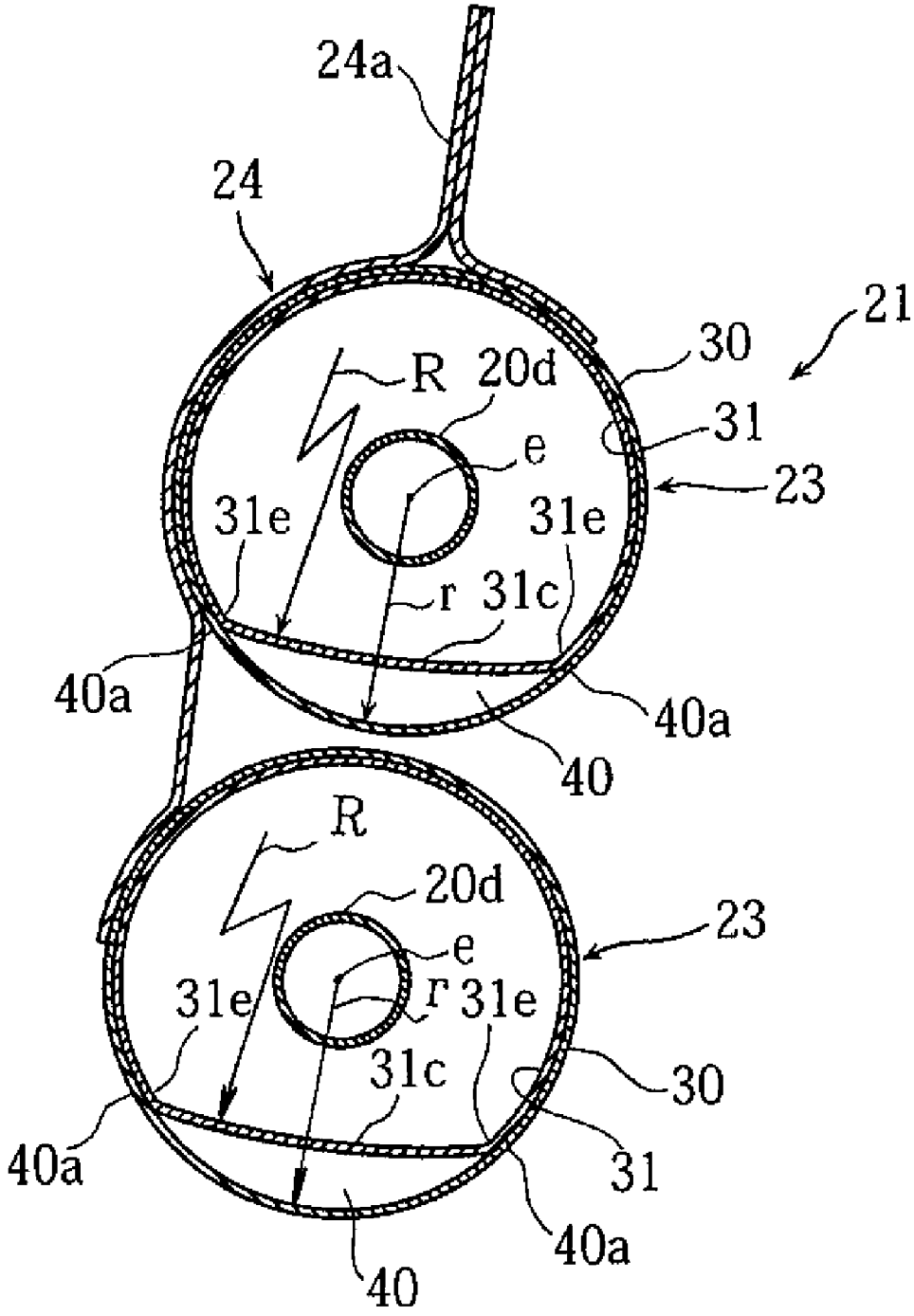
FIG. 5 is a cross sectional view of the muffler taken along line V-V of FIG. 1.

A metal honeycomb type catalyst 22 for cleaning up exhaust gas is disposed in rear inclining part 20*c* (FIG. 4).

Muffler 21 has two upper and lower muffler main bodies 23, 23 arranged in parallel. Bifurcating branches 20*d*, 20*d* are inserted in upper and lower muffler main bodies 23, 23, and fixed there.

A protector 25 functioning as a thermal insulation member covers a part of upper muffler main body 23. A generally triangular protector 26 functioning as a thermal insulation member covers rear inclining part 20*c* and bifurcating branches 20*d*, 20*d* of exhaust pipe 20, and a part where each bifurcating branch 20*d* connects to muffler main body 23.

Upper and lower muffler main bodies 23, 23 are united by a bracket 24 disposed inside in a vehicle width direction. An attachment part 24*a* of bracket 24 protrudes upward from upper muffler main body 23 and is fixed by bolting to a tandem foot bracket 27 mounted on a bottom surface of seat rail 13.

A center of gravity G of exhaust system 50 is positioned at a front edge part of muffler 21. Attachment part 24*a* of bracket 24 is in a vicinity of the rear part of center of gravity G (see FIG. 1).

Muffler 21 is disposed substantially on a front side of a perpendicular line (a) passing through a rotational center 8*a* of rear wheel 8. Muffler 21 extends obliquely upward and generally along seat rail 13 on a right side of rear wheel 8. Viewed laterally, a substantial part of muffler 21 falls in a projection area of rear wheel 8. A top edge part 21*a* of a rear end of muffler 21 generally corresponds to perpendicular line (a) at a top rim part of rear wheel 8. A top edge part 21*b* of a front end of muffler 21 generally corresponds to a front rim part of rear wheel 8.

Upper and lower muffler main bodies 23, 23 comprise outer cylinders 30 having inner cylinders 31 inserted therein (FIG. 4).

An upstream opening 30*a* of outer cylinder 30 is blocked with a generally plate-shaped partition 32. Bifurcating branch 20*d* passes through partition 32 and extends into a central portion of outer cylinder 30.

A downstream end opening 30*b* is blocked with a generally bowl-shaped partition 33. A double wall tail cap 34 is removably fixed to a rear part of partition 33 by a plurality of bolts 35. Two spaces b, b formed between tail cap 34 and partition 33 inhibit an increase of temperature of the tail part.

A tail pipe 36 for communicatively connecting the inside of muffler main body 23 to the outside passes through partition 33 and is fixed there. Tail pipe 36 is in a generally horizontal alignment relative to the vehicle, passes through tail cap 34, and opens rearward.

Inner cylinder 31 is disposed at a center part except for front and rear ends in an axis direction of outer cylinder 30, and contacts an inner peripheral surface of outer cylinder 30.

An upstream end opening 31*a* of inner cylinder 31 opens to communicatively connect with a front part of outer cylinder 30. A downstream end opening 31*b* is blocked with a generally plate-shaped partition 38.

A punched partition 39 is centrally disposed inside inner cylinder 31. A plurality of through holes 39*a* for communicatively connecting spaces inside inner cylinder 31 is formed on punched partition 39 (see FIG. 6(*b*)).

Partition 38 divides an inside of muffler main body 23 into a first expansion chamber (A) on a front side of partition 38 and a second expansion chamber (B) on a rear side of partition 38.

A communicative passage 40 for communicatively connecting first and second expansion chambers (A) and (B) is formed between outer and inner cylinders 30 and 31.

A bottom part 31*c* of inner cylinder 31 is concaved from the inner peripheral surface of outer cylinder 30 in a direction to a center (e) of outer cylinder 30. Specifically, bottom part 31*c* is an arc-shaped part with a radius of curvature R larger than a radius of curvature r of outer cylinder 30. Thereby, a horizontal cross section of communicative passage 40 has an arc shape.

Figure 6:
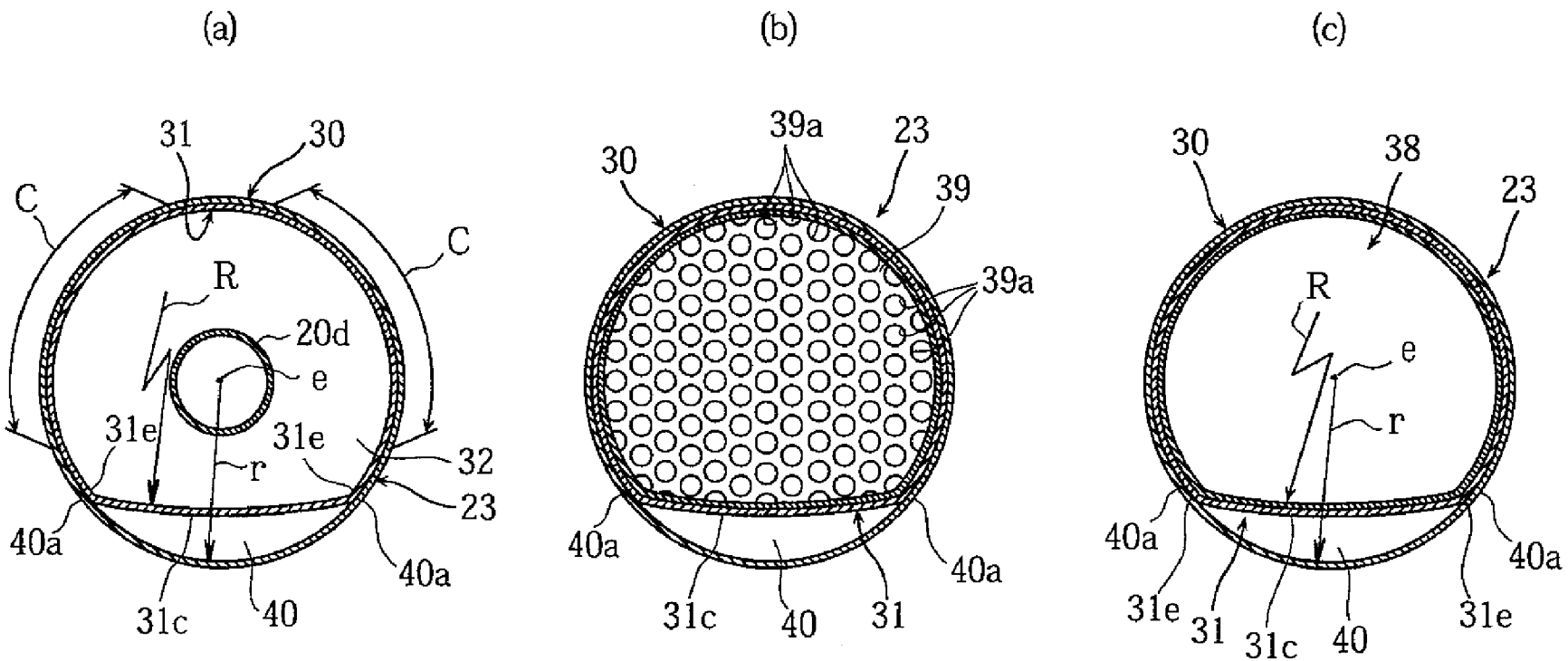
FIG. 6 are cross sectional views of the muffler taken along lines VIa-VIa, VIb-VIb, and VIc-VIc of FIG. 4.

A plurality of weight reducing holes 31*d* are formed by punching (see FIG. 4) over a generally entire surface of a contacting part c where inner cylinder 31 except for bottom part 31*c* contacts outer cylinder 30 (see FIG. 6(*a*)).

Contacting parts 40*a*, 40*a* where right and left edge parts 31*e*, 31*e* of bottom part 31*c* of inner cylinder 31 contact the inner peripheral surface of outer cylinder 30 are welded over an entire length in the axis direction by spot or arc welding.

Exhaust gas exhausted from engine 3 flows inside exhaust pipe 20 and is cleaned when it flows through catalyst 22 of rear inclining part 20*c*. From here, the gas flows through bifurcating branches 20*d*, 20*d* and into muffler main bodies 23, 23.

The flow of exhaust gas through muffler main bodies 23 is depicted by arrows in FIG. 4. Exhaust gas flowing into first expansion chamber A of each muffler main body 23, 23 passes through punched partition 39 inside inner cylinder 31, meets partition 38 positioned at a rear end, and there makes a U-turn frontward. The gas then flows back though expansion chamber A and makes another U-turn rearward when it meets partition 32. The gas then flows inside communicative passage 40 rearward from the front end of outer cylinder 30 and into second expansion chamber B. The gas is then discharged through tail pipe 36.

In this embodiment, muffler main body 23 comprises inner cylinder 31 contacting the inner peripheral surface of outer cylinder 30. Communicative passage 40 for communicatively connecting first and second expansion chambers A and B is formed between inner and outer cylinders 31 and 30. Right and left edge parts 31*e*, 31*e* of inner cylinder 31, which constructs communicative passage 40, are welded to contacting parts 40*a*, 40*a* on outer cylinder 30. As a result, exhaust gas flowing in communicative passage 40 does not enter the space between inner cylinder 31 and outer cylinder 30. Therefore, exhaust sound does not leak from the space between cylinders 30 and 31, thereby assuring a silencing effect.

First and second expansion chambers A, B are communicatively connected together by communicative passage 40 formed between outer and inner cylinders 30 and 31. Thus, a conventional communicative pipe is not necessary, and the weight and cost of the muffler is reduced.

In this embodiment, communicative passage 40 is formed such that a bottom part 31*c* of inner cylinder 31 is concaved from the inner peripheral surface of outer cylinder 30 in a direction to a center (e) of outer cylinder 30. Therefore, without processing outer cylinder 30, communicative passage 40 is formed with a simple structure with bottom part 31*c* of inner cylinder 31 only being deformed inside. This prevents cost increases and deteriorated appearance.

In this embodiment, communicative passage 40 is constructed in a manner such that bottom part 31*c* of inner cylinder 31 is not flat but an arc-shaped part having a radius of curvature R larger than a radius of curvature r of outer cylinder 30. Therefore, a shell sound is prevented while a necessary passage area is assured.

In this embodiment, a plurality of weight reducing holes 31*d* is formed on contacting part c where inner cylinder 31 except for bottom part 31*c* contacts outer cylinder 30, to further reduce the weight of muffler main body 23.

In this embodiment, muffler 21 has upper and lower muffler main bodies 23, 23 arranged in parallel. Thereby, the vehicle has a powerful appearance although the engine is a single cylinder engine.

Bifurcating branches 20*d*, 20*d* of the single exhaust pipe 20 are connected to muffler main bodies 23, 23. Thereby, engine output in medium and high-speed ranges is maintained, and engine output in low and medium speed ranges is improved. In a performance simulation study, engine output is improved by 10% in a range of 2500-4000 rpm relative to an engine having one muffler main body.

In this embodiment, muffler 21 is substantially on a front side of a perpendicular line (a) passing through a rotational center 8*a* of rear wheel 8. Consequently, the center of gravity G of exhaust system 50 is closer to a center of gravity of the vehicle, thereby concentrating mass and improving operational stability.

Attachment part 24*a* of muffler 21 is disposed in the vicinity of the rear part of the center of gravity G. Exhaust system 50 is attached to vehicle body frame 2 at a single place. This eases assembly and results in cost reduction.

Figure 7:
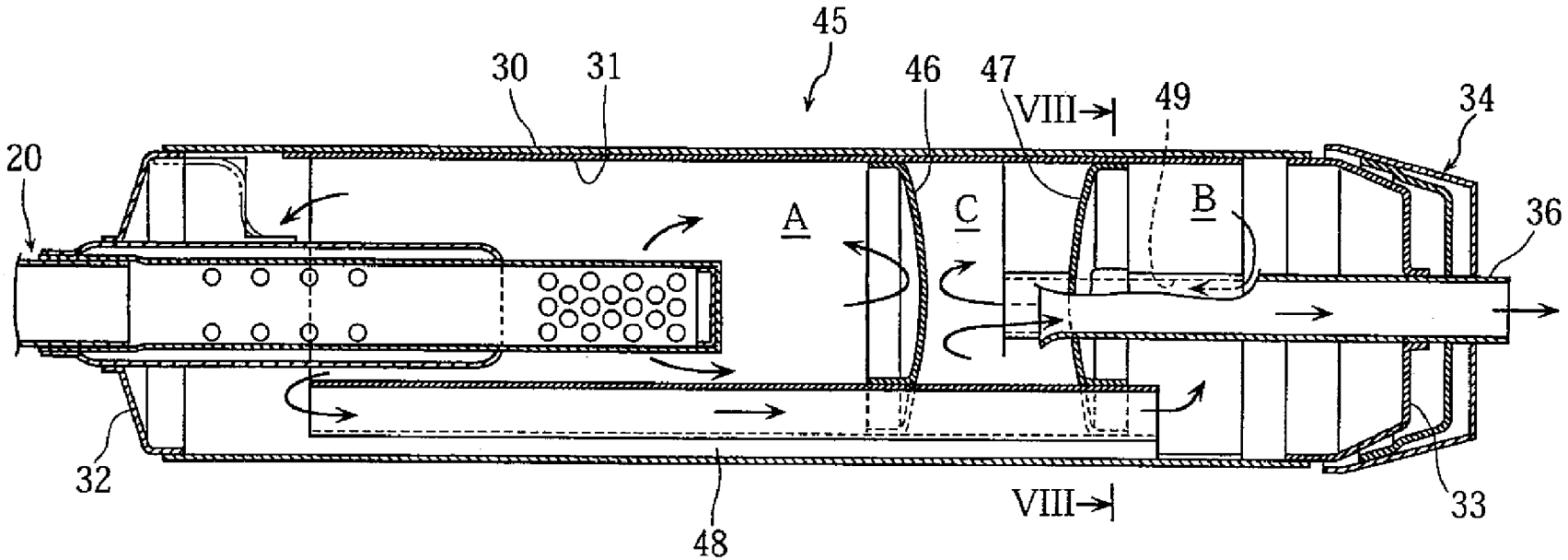
FIG. 7 is a cross sectional view of a muffler according to a second embodiment of the present invention.
Figure 8:
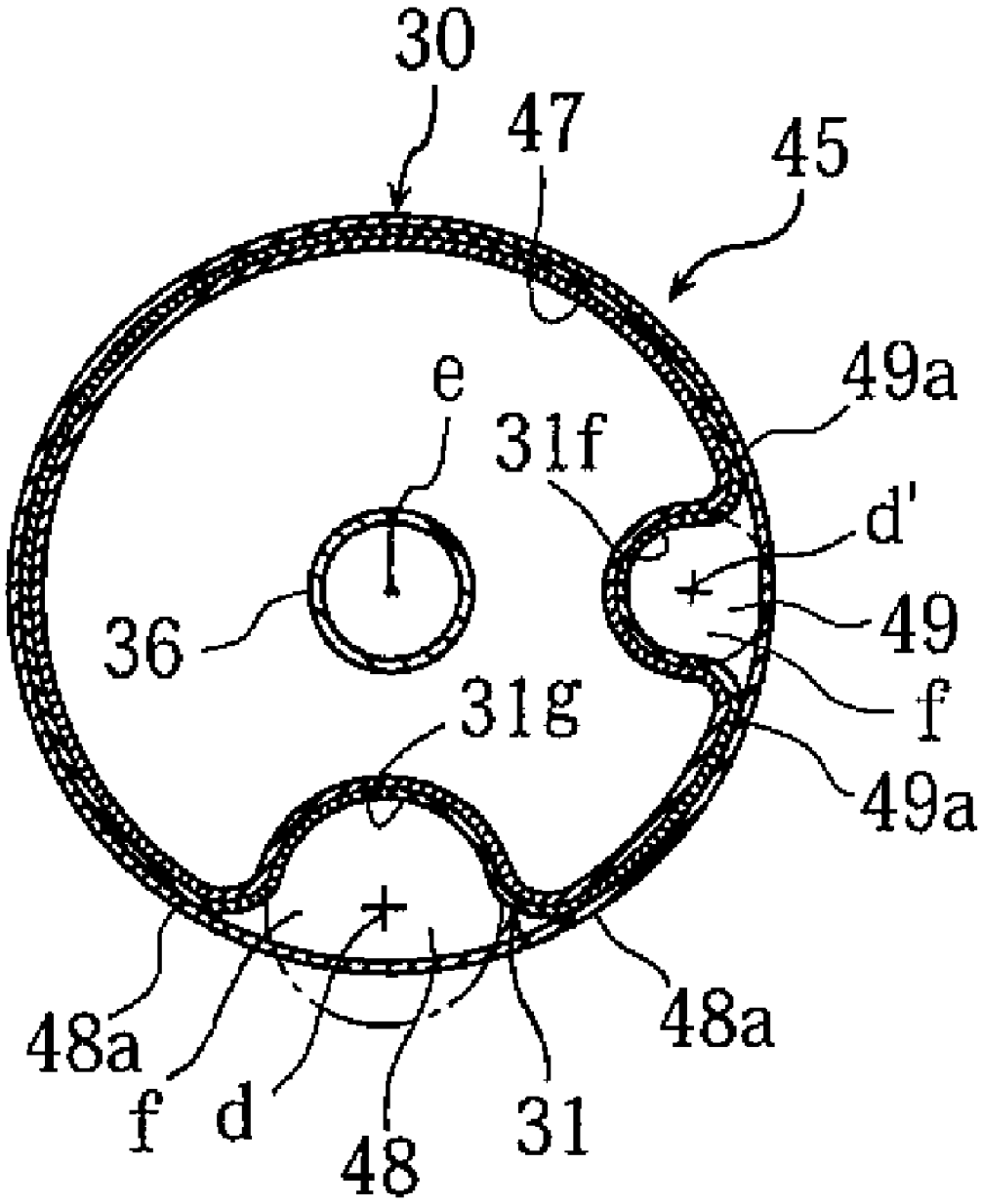
FIG. 8 is a cross sectional view of the muffler taken along line VIII-VIII of FIG. 7.

FIGS. 7 and 8 depict an exhaust system according to a second embodiment of the present invention. In FIGS. 7 and 8, reference numerals and symbols the same as those in FIG. 4 designate the same or equivalent parts.

The exhaust system of this embodiment includes a muffler 45. Muffler 45 has an inner cylinder 31 inserted in and contacting the inner peripheral surface of outer cylinder 30. The inside of muffler 45 is separated into first, second, and third expansion chambers A, B, and C by two partitions 46 and 47.

First and second expansion chambers A and B are communicatively connected by a first communicative passage 48 formed between outer and inner cylinders 30 and 31. Second and third expansion chambers B and C are communicatively connected by a second communicative passage 49 formed between outer and inner cylinders 30 and 31. The basic construction is generally the same as in the first embodiment.

First and second communicative passages 48 and 49 are formed such that a bottom part 31*g* and a side part 31*f* of inner cylinder 31 are deformed to form arcs whose centers of curvatures d and d', respectively, are positioned closer to outer cylinder 30 than to the inner peripheral surface of inner cylinder 31. In other words, communicative passages 48 and 49 are formed such that bottom part 31*g* and side part 31*f* are concaved so that each of them forms an arc inside. Bottom part 31*g* and side part 31*f* form a generally cylindrical ring part f.

Both edge parts of bottom part 31*g* and side part 31*f* of inner cylinder 31, which form first and second communicative passages 48 and 49, contact the inner peripheral surface of outer cylinder 30 at contacting parts 48*a*, 48*a* and 49*a*, 49*a*. Contacting parts 48*a*, 48*a* and 49*a*, 49*a* are welded over an entire length in an axis direction by spot or arc welding.

As depicted by arrows in FIG. 7, exhaust gas passes through inside exhaust pipe 20 and flows into first expansion chamber A in muffler 45. The gas meets partition 46 and there makes a U-turn frontward. Then, the gas flows rearward in communicative passage 48 and flows into second expansion chamber B. Form here, the gas flows frontward inside second communicative passage 49 and flows into third expansion chamber C. The gas flows out from third expansion chamber C passing through tail pipe 36, and is discharged outside.

According to this embodiment, muffler 45 comprises inner cylinder 31 contacting the inner peripheral surface of outer cylinder 30. First communicative passage 48 for communicatively connecting first and second expansion chambers A and B, and second communicative passage 49 for communicatively connecting second and third expansion chambers B and C are formed between inner cylinder 31 and outer cylinder 30. First and second communicative passages 48 and 49 are formed in a manner such that contacting parts 48*a* and 49*a* where inner cylinder 31 contacts outer cylinder 30 are welded. Thereby, a silencing function is assured while weight is reduced. Therefore, an effect generally equivalent to the first embodiment is obtained.

The particular embodiments of the invention described in this document should be considered illustrative, rather than restrictive. Modification to the described embodiments may be made without departing from the spirit of the invention as defined by the following claims.

The invention claimed is:

1. An exhaust system comprising:

an engine;

an exhaust pipe connected to the engine;

a muffler connected to the exhaust pipe, wherein the muffler has an inner cylinder disposed in an outer cylinder, and is separated into a plurality of expansion chambers with partitions, wherein the end of the exhaust pipe extends into a central portion of the outer cylinder and faces the partitions which divide an inside of a main body of the muffler into a first expansion chamber on a front side of the partition and a second expansion chamber on a rear side of the partition;

a muffling member having multiple through holes placed between the end of the exhaust pipe and the partitions;

a communicative passage for communicatively connecting the expansion chambers is formed between the outer cylinder and the inner cylinder;

a plurality of weight reducing holes are formed in a contacting part where the inner cylinder contacts the outer cylinder except for a part constructing the communicative passage; and both edge portions of a part of the inner cylinder constructing the communicative passage contact the outer cylinder at least over a predetermined length in a longitudinal direction of the inner cylinder and are welded thereto.

2. The exhaust system according to claim 1, wherein the inner cylinder contacts an inner peripheral surface of the outer cylinder, and the communicative passage is formed in a manner such that the part of the inner cylinder is concaved from the inner peripheral surface of the outer cylinder in a direction to a center of the outer cylinder.

3. The exhaust system according to claim 2, wherein the communicative passage includes an arc-shaped part formed by setting a radius of curvature of the part of the inner cylinder larger than a radius of curvature of the outer cylinder.

4. The exhaust system according to claim 2, wherein the part of the inner cylinder constructing the communicative passage is a ring part with its center positioned closer to the outer cylinder than to the inner peripheral surface of the inner cylinder.

5. The exhaust system according to claim 1, wherein the exhaust pipe has an exhaust pipe main body connected to the engine and a bifurcating part such that the exhaust pipe main body is bifurcated into two pipes in its downstream, the muffler has a pair of muffler main bodies arranged in parallel, and each of the muffler main bodies is connected to a bifurcating branch of the bifurcating part, wherein the bifurcating branch extends into the central portion of the outer cylinder and the inner cylinder is disposed at a center part except for front and rear ends in an axial direction of the outer cylinder, and contacts an inner peripheral surface of the outer cylinder, and an upstream end opening of the inner cylinder opens to communicatively connect with a front part of the outer cylinder and a downstream end opening is blocked with a generally plate-shaped partition and a punched partition is centrally disposed inside the inner cylinder, and a plurality of through holes for communicatively connecting spaces inside the inner cylinder is formed on the punched partition.

6. A motorcycle comprising the exhaust system of claim 1.

7. The motorcycle according to claim 6, wherein the muffler is attached substantially on a front side of a perpendicular line passing through a rotational center of a rear wheel.

8. The motorcycle according to claim 6, wherein a center of gravity of the exhaust system is positioned near the connection of the exhaust pipe and the muffler, and a vicinity of the center of gravity of the exhaust system is mounted on the vehicle body frame.

9. The exhaust system according to claim 1, comprising two expansion chambers.

10. The exhaust system according to claim 1, comprising three expansion chambers.

* * * * *